United States Patent [19]

Simmons, Sr.

[11] 4,011,695

[45] Mar. 15, 1977

[54] BLEACHER SYSTEM

[75] Inventor: William B. Simmons, Sr., Geneva, Ala.

[73] Assignees: William M. Russell, Jr.; Mary L. Russell, both of Geneva, Ala.

[22] Filed: Oct. 7, 1975

[21] Appl. No.: 620,363

[52] U.S. Cl. ..... 52/8; 52/9; 52/690; 182/228; 108/64

[51] Int. Cl.[2] ..... E04H 3/12; E04C 3/02

[58] Field of Search ..... 52/6, 8, 9, 10, 177, 52/180, 181, 182, 188, 179, 690; 108/64, 111, 159; 211/134, 186; 182/228, 222

[56] References Cited

UNITED STATES PATENTS

| | | | |
|---|---|---|---|
| 1,715,885 | 6/1929 | Annand et al. | 52/8 |
| 2,186,866 | 1/1940 | Hussey | 52/690 |
| 2,193,339 | 3/1940 | McCann | 52/690 |
| 2,287,561 | 6/1942 | Page et al. | 52/690 |
| 2,556,922 | 6/1951 | Hudson | 108/159 |
| 2,817,389 | 12/1957 | Richards | 52/8 |
| 2,985,924 | 5/1961 | Burke | 52/8 |
| 3,150,617 | 9/1964 | Phillips | 108/111 |
| 3,334,456 | 8/1967 | Naka | 52/181 |
| 3,381,775 | 5/1968 | Livers | 52/182 |
| 3,608,256 | 9/1971 | Jefferys | 52/179 |

*Primary Examiner*—Price C. Faw, Jr.
*Assistant Examiner*—Robert C. Farber
*Attorney, Agent, or Firm*—Clarence A. O'Brien & Harvey B. Jacobson

[57] ABSTRACT

A spectator bleacher structure assembled from extruded metal sections including base, end support, tread members and posts. The end support members interconnect the posts and are bridged by the tread members. The tread members have reinforcing channel flanges depending therefrom with snap-in prongs inserted into slots formed in the end support members.

15 Claims, 8 Drawing Figures

BLEACHER SYSTEM

This invention relates to a modular bleacher structure adapted to be assembled at a desired location for use by spectators.

Portable or knockdown types of bleacher structures are well known as disclosed for example in U.S. Pat. Nos. 1,715,885, 2,186,866, 2,287,561 and 2,985,924. One of the major problems associated with such prior knockdown bleacher structures resides in obtaining a suitably rigid assembly with a minimum number of separate parts. Another problem associated with such prior bleacher structures resides in the time and effort required in assembling the structure. It is therefore an important object of the present invention to provide a knockdown type of bleacher structure having a minimal number of parts but endowed with an unexpected degree of rigidity. An additional object is to provide a bleacher structure capable of being more easily assembled with minimal effort and expenditure of time.

In accordance with the present invention, a bleacher structure is assembled from tubular posts of varying height interconnected by channel-shaped end support members having socket end portions embracing the posts. Load supporting seat and footrest members bridge the end support members between the posts and the tops of the posts themselves. Each of the seat and footrest members is of a channel-shaped construction with intermediate reinforcing flanges depending therefrom. Prong formations on the reinforcing flanges form snap-in connections between the seat and footrest members and the end supporting members. Additional end supporting members longer than the others are provided in order to interconnect at least three of the longer posts to form a more rigid assembly.

These together with other objects and advantages which will become subsequently apparent reside in the details of construction and operation as more fully hereinafter described and claimed, reference being had to the accompanying drawings forming a part hereof, wherein like numerals refer to like parts throughout.

Figures 1, 7:
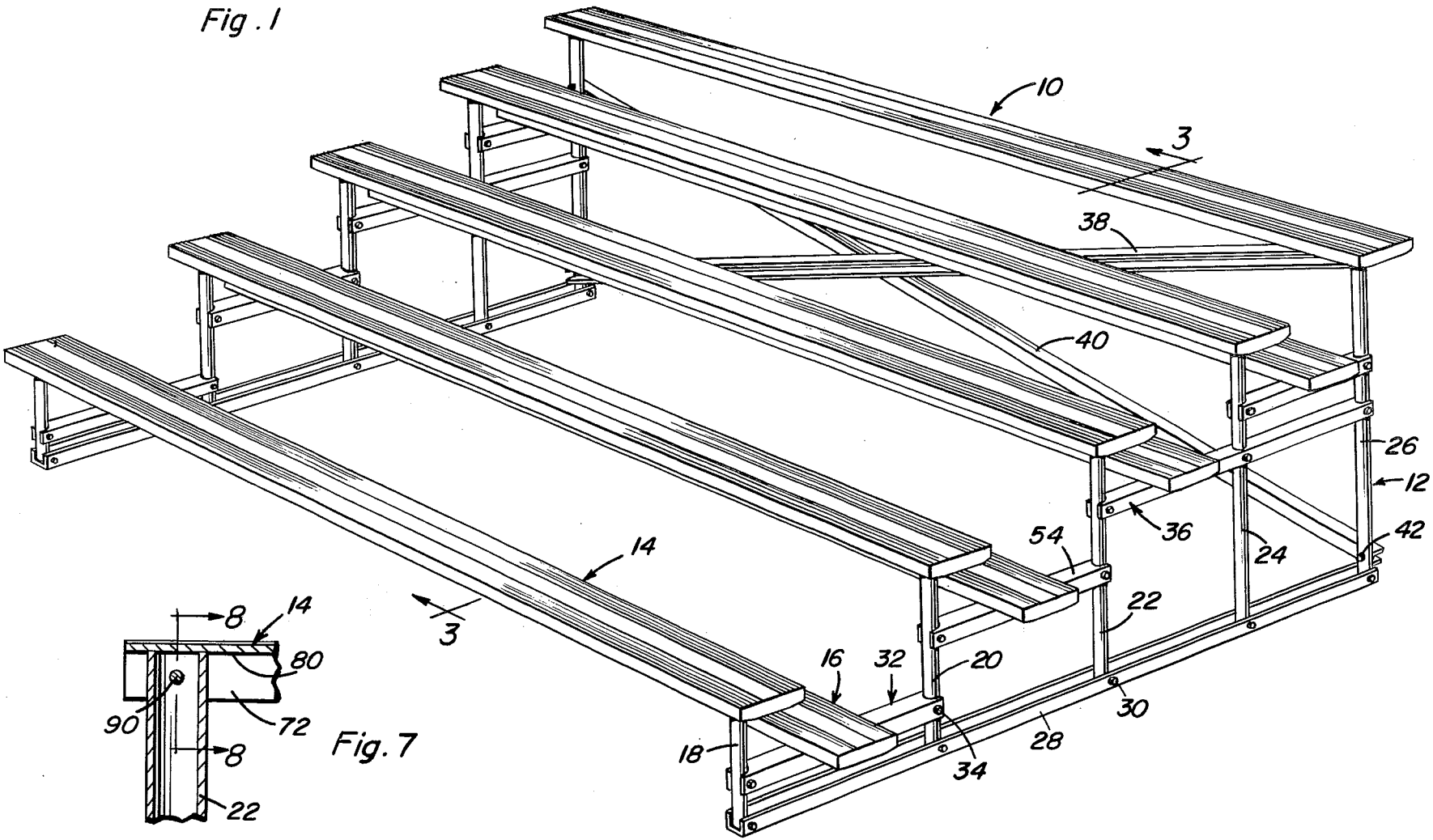
FIG. 1 is a perspective view showing a typical bleacher section constructed and assembled in accordance with the present invention.
FIG. 7 is an enlarged partial sectional view taken substantially through a plane indicated by section line 7—7 in FIG. 3.

Referring now to the drawings in detail, FIG. 1 illustrates a bleacher section structure generally referred to by reference numeral 10 assembled from a plurality of parts in the form of extruded sections made of a metal such as aluminum. The bleacher section includes basically two parallel spaced end sub-assemblies generally referred to by reference numeral 12 which are bridged by two similar types of load-supporting tread members 14 and 16. The tread members 14 are supported at different heights by the end sub-assemblies 12 and form seats for spectators whereas the tread members 16 constitute the footrests. The length of the tread members 14 and 16 is sufficient to slightly overhang the two parallel spaced end sub-assemblies 12 when a single bleacher section is erected as shown in FIG. 1. It will of course be appreciated that longer tread members will be utilized where two or more sections are assembled as a single unit in which case there will be at least three parallel spaced sub-assemblies 12. Also, it will be appreciated that while a five row bleacher section 10 is shown, different numbers of rows could be assembled if desired.

Figure 3:
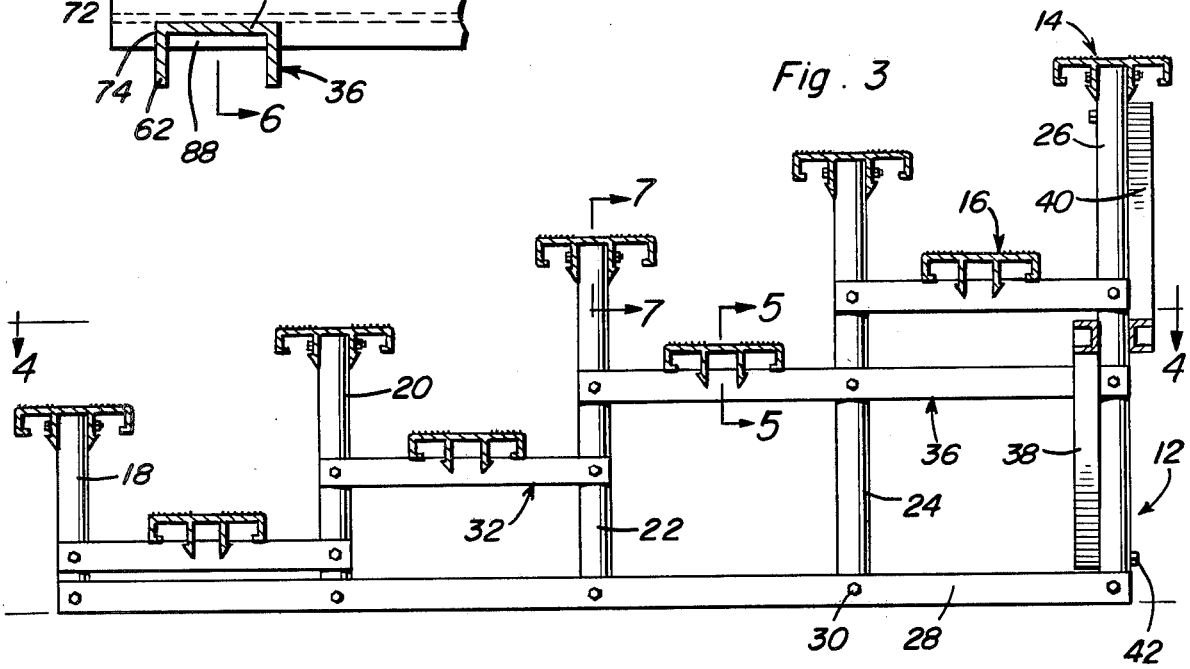
FIG. 3 is a side sectional view taken substantially through a plane indicated by section line 3—3 in FIG. 1.
Figure 4:
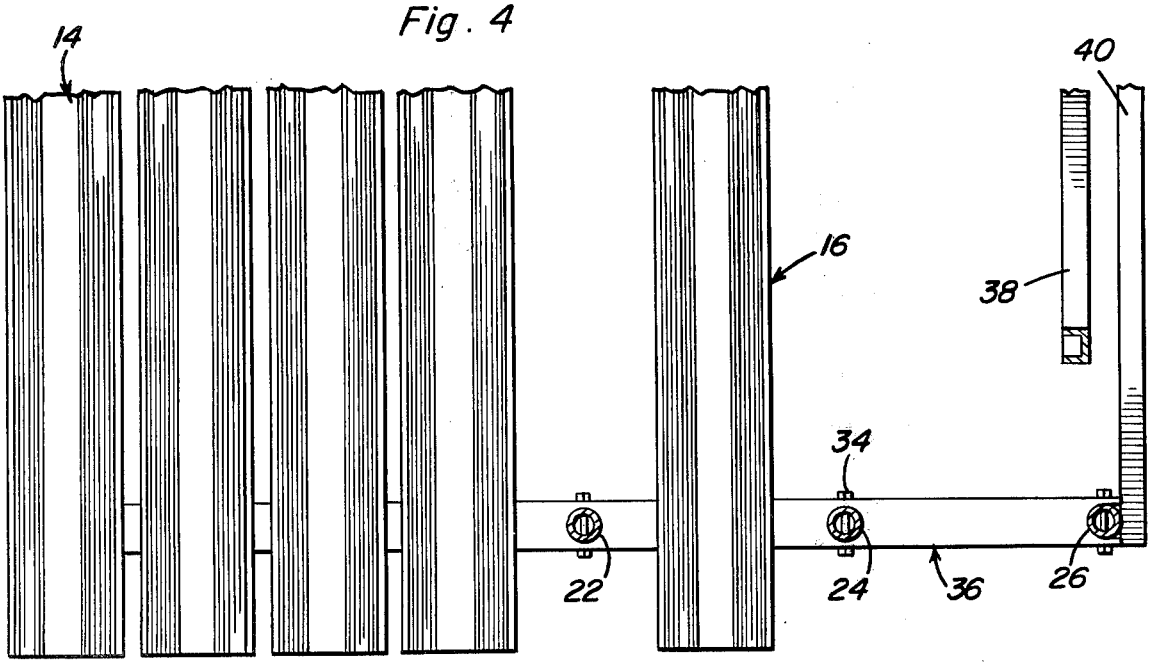
FIG. 4 is a top sectional view taken substantially through a plane indicated by section line 4—4 in FIG. 3.

Each of the end sub-assemblies 12 includes a plurality of tubular posts 18, 20, 22, 24 and 26, of progressively increasing height or length. The posts are interconnected to and extend upwardly from a channel-shaped base member 28 to which the posts are secured by bolt assemblies 30. The posts are also interconnected in spaced relationship to each other by end support members 32, fastener bolt assemblies 34 being utilized to secure the end support members to the posts. An additional longer end support member generally referred to by reference numeral 36 interconnects the three longer posts 22, 24 and 26 in parallel spaced relationship to the shorter end support member 32 interconnecting the posts 24 and 26. The end support members 32 and 36 are furthermore positioned at different levels in order to support the footrest members 16 at the desired height. The end sub-assemblies 12 in addition to being interconnected by the tread members 14 and 16, are also interconnected by channel-shaped cross bracing members 38 and 40 abutting the posts 26 on opposite sides and interconnected therewith by bolt assemblies 42 as more clearly seen in both FIGS. 1 and 3.

Figure 2:
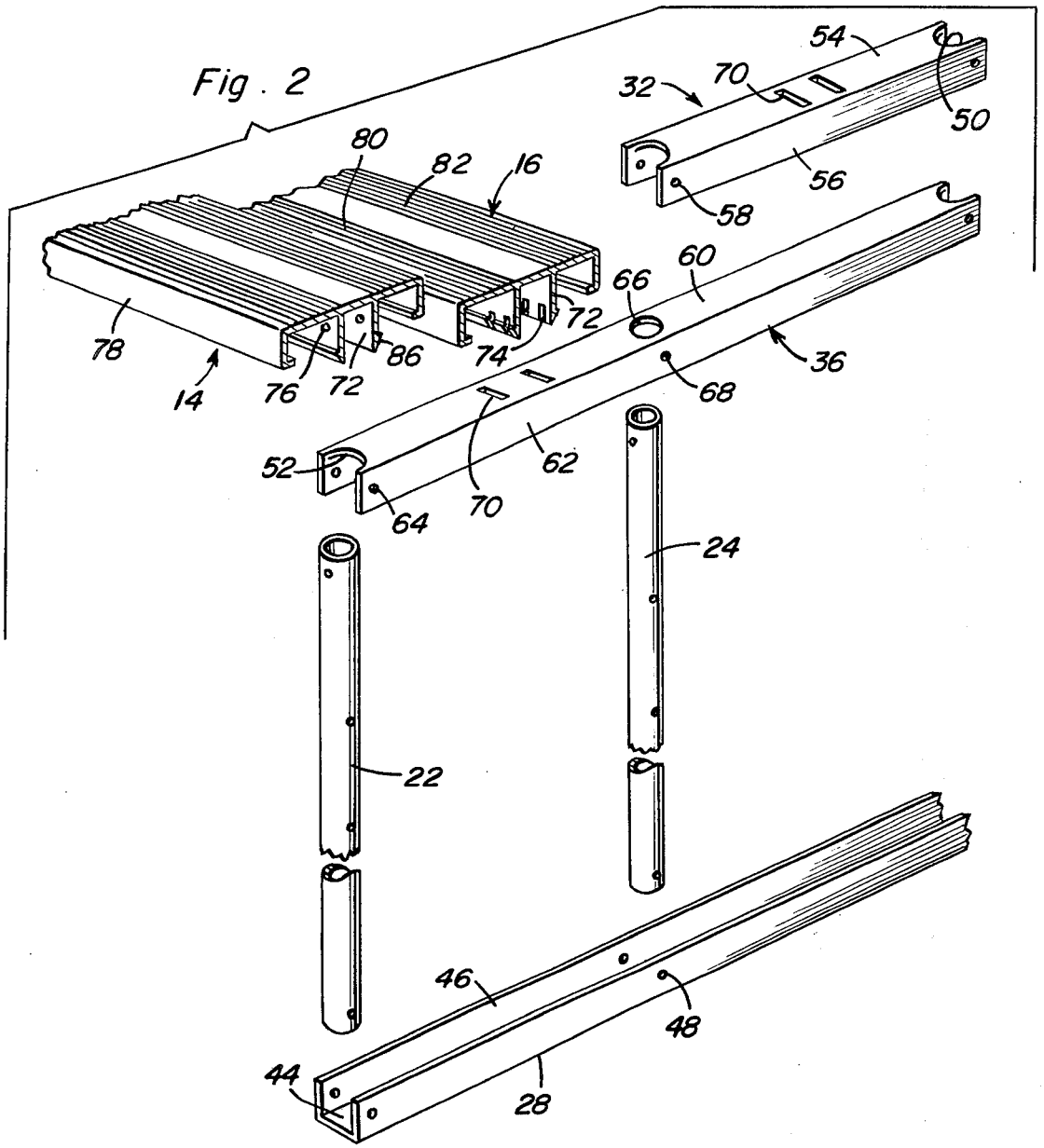
FIG. 2 is a perspective view showing typical disassembled parts of the bleacher structure.

The basic components of the bleacher structure are more clearly shown in FIG. 2 wherein the base member 28 aforementioned is in the form of a channel-shaped member wherein the web 44 constitutes the ground bearing portion from which the channel flanges 46 extend upwardly. The tubular posts are received between the flanges 46 in alignment with openings 48 through which the fastener bolt assemblies 30 extend. Although the tubular posts are shown to be generally circular in cross section, it will be appreciated that other cross-sectional shapes may be utilized such as square or rectangular post sections. The posts are embraced by socket end portions 50 of the shorter end support members 32 and socket end portions 52 of the longer end support members 36. Both types of end support members are in the form of inverted channel sections. The upper web portions 54 of the shorter end support members 32 are bridged by the tread members 16 while the depending channel flanges 56 are provided with openings 58 at the socket end portions in order to receive the fastener bolt assemblies 34 through which the end support members 32 are secured to the posts. The longer end support members 36 are also provided with upper web portions 60 from which the channel flanges 62 depend, the channel flanges being provided with openings 64 at the socket end portions 52 in order to receive fastener bolt assemblies securing the end support members 36 to the posts. The upper web portions 60 of the longer end support members 36 are provided intermediate the end portions with openings 66 through which the posts 24 extend. Accordingly, bolt openings 68 are also formed in the flanges 62 in alignment with the posts 24 for securing the same to the end support members. Both the end support members 32 and 36 are provided with spaced slots 70 over which the end portions of the tread members 16 rest and through which the tread members are secured to the end support members. While the slots 70 are formed in the upper web portion 54 centrally between the end portions 50 on the end support member 32 as shown in FIG. 2, the slots 70 are centrally located between the end portion 52 and one side of the opening 66 as shown in FIG. 2. The spaced slots 70 are adapted to be aligned with a pair of reinforcing channel flanges 72 associated with both of the tread members 14 and 16. As shown in FIG. 2, the reinforcing flanges 72 are provided with spaced notches 74 adjacent each end portion of the tread member 16 whereas the reinforcing flanges 72 associated with the tread member 14, are provided with aligned openings 76 adjacent the end portions.

Figure 6:
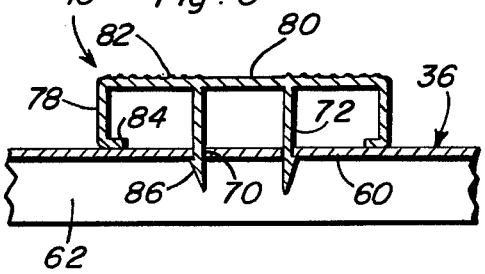
FIG. 6 is a partial sectional view taken substantially through a plane indicated by section line 6—6 in FIG. 5.
Figure 5:
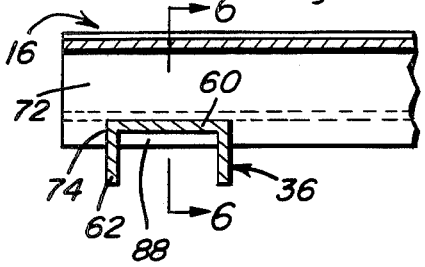
FIG. 5 is an enlarged partial sectional view taken substantially through a plane indicated by section line 5—5 in FIG. 3.

As more clearly seen in FIGS. 5 and 6, the tread members are provided with outer flanges 78 interconnected by a load supporting web 80. The upper surface of the web 80 is formed with spaced, slip-resistant surface portions 82. Also, the outer flanges 78 are provided with inturned edge portions 84 adapted to rest on the upper web portions 54 and 60 of the end support members 32 and 36. The reinforcing flanges 72 depend from the web portion 80 below the inturned edge portions 84 of the flanges 78 as more clearly seen in FIG. 6. The lower end portions of the reinforcing flanges 72 are provided with hook-shaped prong formations 86. Sections 88 of the prong formations between the spaced notches 74 are adapted to be inserted through the slots 70 and thereby form a snap-in connection between the tread member and the end support member, as more clearly seen in FIGS. 5 and 6.

Figure 8:
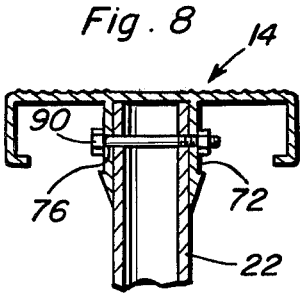
FIG. 8 is a partial sectional view taken substantially through a plane indicated by section line 8—8 in FIG. 7.

The tread members 14 are supported between the reinforcing flanges 72 on top of the posts as more clearly seen in FIGS. 7 and 8. Each tread member 14 is therefore interconnected with a post by means of a fastener bolt assembly 90 extending through the openings 76 in the reinforcing flanges 72.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In a bleacher structure having adjacent tubular posts interconnected by supports and channel shaped members connected to the supports between the posts, each of said channel-shaped members having parallel spaced supporting flanges resting on associated supports, a load supporting web interconnecting the supporting flanges, and spaced reinforcing flanges intermediate the supporting flanges depending from the web below the supporting flanges, and fastener means for securing the reinforcing flanges to the associated supports.

2. The combination of claim 1 wherein said fastener means includes spaced slots formed in the supports and snap-in prongs formed on the reinforcing flanges received in said slots.

3. The combination of claim 2 wherein said reinforcing flanges are formed with spaced notches between which insert sections of the prongs are received within the slots in the supports.

4. The combination of claim 3 wherein said prongs project from the reinforcing flanges in close spaced relation below the supporting flanges.

5. The combination of claim 4 wherein the load supporting web is formed with spaced, slip resistant surface portions.

6. The combination of claim 5 wherein each of said supports comprises an inverted channel section having socket end portions embracing two of the posts to which the support is secured.

7. The combination of claim 6 wherein said supports include longer and shorter channel sections, each of the longer channel sections having an opening formed intermediate the end portions thereof to receive a third of the posts therethrough.

8. The combination of claim 1 wherein each of said supports comprises an inverted channel section having socket end portions embracing two of the posts to which the support is secured.

9. The combination of claim 8 wherein said supports include longer and shorter channel sections, each of the longer channel sections having an opening formed intermediate the end portions thereof to receive a third of the posts therethrough.

10. The combination of claim 2 wherein said prongs project from the reinforcing flanges in close spaced relation below the supporting flanges.

11. The combination of claim 1 wherein the load supporting web is formed with spaced, slip resistant surface portions.

12. In a bleacher structure having adjacent tubular posts interconnected by end supports for channel-shaped members extending between the posts, each of said channel-shaped members having parallel spaced supporting flanges resting on the end supports, a load supporting web interconnecting the supporting flanges, and spaced reinforcing flanges depending from the web below the supporting flanges, and fastener means for securing the reinforcing flanges to the associated supports and the posts.

13. The combination of claim 12 wherein the reinforcing flanges associated with some of the channel-shaped members are formed with spaced notches between which insert sections are defined, said insert sections being received within slots formed in the supports.

14. The combination of claim 12 wherein each of said supports comprises an inverted channel section having socket end portions embracing two of the posts to which the support is secured.

15. The combination of claim 14 wherein said supports include longer and shorter channel sections, each of the longer channel sections having an opening formed intermediate the end portions thereof to receive a third of the posts therethrough.

* * * * *